US010265712B2

(12) United States Patent
Reichler et al.

(10) Patent No.: US 10,265,712 B2
(45) Date of Patent: Apr. 23, 2019

(54) NOZZLE HEAD AND ROTARY ATOMIZER HAVING SUCH A NOZZLE HEAD

(71) Applicant: Eisenmann SE, Boeblingen (DE)

(72) Inventors: Jan Reichler, Constance (DE); Herbert Schulze, Aidlingen (DE)

(73) Assignee: EISENMANN SE, Boeblingen (DE)

( * ) Notice: Subject to any disclaimer, the term of this patent is extended or adjusted under 35 U.S.C. 154(b) by 187 days.

(21) Appl. No.: 14/974,053

(22) Filed: Dec. 18, 2015

(65) Prior Publication Data

US 2016/0193616 A1 Jul. 7, 2016

(30) Foreign Application Priority Data

Dec. 20, 2014 (DE) ..... 10 2014 019 309

(51) Int. Cl.
*B05B 3/00* (2006.01)
*B05B 3/10* (2006.01)

(52) U.S. Cl.
CPC ..... *B05B 3/1014* (2013.01)

(58) Field of Classification Search
CPC ..... B05B 3/1007; B05B 3/1014
USPC ..... 239/223, 224
See application file for complete search history.

(56) References Cited

U.S. PATENT DOCUMENTS 4,148,932 A 4/1979 Tada et al.
4,505,430 A 3/1985 Rodgers et al.
4,943,005 A * 7/1990 Weinstein ..... B05B 3/1064 239/223
5,137,215 A * 8/1992 Degli ..... B05B 5/0407 239/223
5,676,756 A 10/1997 Murate et al.
5,788,164 A * 8/1998 Tomita ..... B05B 3/1064 239/112
5,813,608 A * 9/1998 Yoshioka ..... B05B 3/1014 239/110
5,909,849 A * 6/1999 Yamasaki ..... B05B 3/1014 239/224
8,690,076 B2 * 4/2014 Yamasaki ..... B05B 3/1014 239/223

FOREIGN PATENT DOCUMENTS

DE 37 31 138 A1 5/1988
DE 690 02 043 T2 9/1993
DE 43 30 602 A1 3/1994
EP 0 120 648 A2 10/1984

* cited by examiner

*Primary Examiner* — Viet Le
(74) *Attorney, Agent, or Firm* — Schroeder Intellectual Property Law Group, LLC

(57) ABSTRACT

A nozzle head for a rotary atomizer for applying a coating material to an object includes a rotary bell, which is rotatable about an axis of rotation and has a breakaway edge and a discharge surface to which the coating material can be supplied in such a way that the coating material is spun off from the breakaway edge of the rotary bell. Coating material can be supplied to the discharge surface via a flow path. The flow path is divided in a delivery region into sub-paths, each having a delivery opening which is arranged eccentrically to the axis of rotation of the rotary bell and from which the coating material, which arrives from there at the discharge surface, can be delivered. A rotary atomizer having a nozzle head of this type is also described.

15 Claims, 4 Drawing Sheets

NOZZLE HEAD AND ROTARY ATOMIZER HAVING SUCH A NOZZLE HEAD

RELATED APPLICATIONS

This application claims the filing benefit of German Patent Application No. 10 2014 019 309.8, filed Dec. 20, 2014, the contents of which are incorporated herein by reference.

BACKGROUND OF THE INVENTION

1. Field of the Invention

The invention relates to a nozzle head for a rotary atomizer for applying a coating material to an object, having a) a rotary bell which is rotatable about an axis of rotation and has a breakaway edge and a discharge surface to which the coating material can be supplied in such a way that the coating material is spun off from the breakaway edge of the rotary bell, and b) a flow path via which the coating material can be supplied to the discharge surface.

The invention moreover relates to a rotary atomizer for applying a coating material to an object with a nozzle head.

2. Description of the Prior Art

Rotary atomizers which are equipped with a nozzle head of the type mentioned at the outset are used for example in the automotive industry to paint objects, such as parts of vehicle bodies, or to coat them with a protective material.

The rotary bell here serves to atomize the coating material, for which it is rotatedabout its axis of rotation at very high rotational speeds of 10,000 to 100,000 rpm by means of a pneumatic or electric drive during operation.

The selected coating material is supplied to the rotating rotary bell. As a result of centrifugal forces which act on the coating material, it is driven outwards to the rotary bell as a film, until it arrives at a radially outer breakaway edge of the rotary bell. Here, high centrifugal forces act on the coating material in such a way that it is spun off tangentially in the form of fine coating-material droplets.

During this, droplets of different sizes are produced, which cover a relatively large size range. Larger droplets are spun radially further outwards than smaller droplets. With nozzle heads and rotary atomizers of the type mentioned at the outset, a relatively wide spray jet is thus generated, which is ideally conical and has a relatively large cone angle.

It is desirable here if the size of the droplets is relatively uniform and if the range on the size-related droplet spectrum is as small as possible. Moreover, the droplets should be as small as possible since a more homogeneous coating result is achieved with smaller droplets. The aim is to generate a so-called paint mist. The term mist generally refers to a mixture of air and finely distributed solid or liquid particles. To ensure that the coating material is applied to the object to be coated, a wetting mist with a minimum droplet size in the range of 20 to 40 μm is required. Good results can be achieved with a mean droplet size of 100 μm, with the deviation ideally being ±50 μm.

The more slowly the rotary bell is rotated, the larger, on average, are the droplets which are spun off from the breakaway edge. Accordingly, droplets generated at the breakaway edge of the rotary bell are, on average, smaller at higher rotational speeds of the rotary bell. For this reason, the rotary bell is generally operated at high speeds, which involves a correspondingly high energy consumption. At the same time, the radial dispersion of the spray jet is in turn greater at higher speeds than at lower speeds, which means that measures have to be implemented to focus this spray jet onto the objects to be coated.

To this end, known rotary atomizers operate for example electrostatically. In this case, the coating material to be applied is charged, whilst the object to be coated is earthed. With this, an electrical field forms between the rotary atomizer and the object, as a result of which the charged coating material is applied in directed manner to the object. However, this only functions in the case of electrically conductive objects.

Alternatively or also in addition to the electrostatic operation, guide air devices have become established in known rotary atomizers. With these, a generally annular guide air flow is conducted onto the spray jet in such a way that this latter is collimated and the different-sized droplets are guided to the object to be coated.However, strong guide air flows are sometimes required for this, the generation of which is relatively complex.

DE 43 30 602 A1 discloses a rotary atomizer for electrostatic coating with a static nozzle assembly, which has a plurality of coating-material nozzles which communicate with corresponding coating-material sources by way of various channels. Each nozzle and the channel connected thereto are used to supply only a specific coating material.

This entails a very complex internal design of the rotary atomizer and therefore increased production costs. There is furthermore a risk that coating material which resides in the individual channel over a relatively long period of time will form deposits on the channel walls. When the channel is used again, these deposits can become loose and lead to an unusable coating result.

SUMMARY OF THE INVENTION

An object of the invention is to provide a nozzle head and a rotary atomizer of the type mentioned at the outset, with which it is possible to achieve an energy-efficient operation with a spray jet which is as homogeneous and focused as possible.

This object may be achieved with the nozzle head of the type mentioned at the outset in that c) the flow path is divided in a delivery region into sub-paths, each with a delivery opening which is arranged eccentrically to the axis of rotation of the rotary bell and from which the coating material, which arrives from there at the discharge surface, can be delivered.

With a central supply of the coating material to the deflection body by way of a coaxially arranged channel, the coating material, depending on its viscosity, can have too low a speed in the radial and circumferential direction to produce the desired material film on the discharge surface.

The invention is based on the knowledge that, when the coating material is conducted via a plurality of sub-paths through a delivery region with delivery openings which are offset radially with respect to the axis of rotation, a more uniform delivery to the discharge surface is possible than with a single central supply channel.

Provision can be made in particular for the delivery openings to be arranged rotatably about the axis of rotation. In this case, a rotational movement of the discharge openings about the axis of rotation causes the coating material to experience an additional acceleration in the radial and the circumferential direction, so that it strikes the deflection body and arrives at the discharge surface with the corresponding additional speed components. This additional kinetic energy is also available to the coating material as it flows along the discharge surface in the direction of the breakaway edge. This enables the coating material to be released from the breakaway edge at a higher speed without it being necessary to increase the operational speed of the rotary atomizer.

Dividing the flow path into sub-paths results in a smaller effective cross-section in each sub-path. If the total cross-section of the sub-paths is smaller than the cross-section of the flow path, the flow rate for an incompressible coating material increases proportionally as a result of the conservation of mass. The absolute speed of the coating material can thereby be further increased.

The droplet sizes generated can be reduced effectively in this way without it being necessary to increase the speed of the rotary atomizer.

The delivery region preferably has at least two delivery openings, which are arranged on a circle which is coaxial to the axis of rotation. To prevent the coating result from exhibiting an intermittency which is linked to the operational speed, it is expedient to distribute the sub-paths with the delivery openings uniformly at the circumference. The formation of a coating-material film which is cohesive in the circumferential direction can thereby be achieved on the discharge surface when the rotary bell rotates, so that droplets can be spun off from as large a circumferential area as possible per unit of time.

In one embodiment, provision is made for the flow path to comprise a coaxial central channel, which is arranged upstream of the delivery region in the flow direction of the coating material.

It is advantageous here if at least the coaxial central channel is received in a drive shaft to which the rotary bell is coupled.

The coating material delivered by the delivery openings can arrive at the discharge surface in that it can be guided onto a deflection body. The deflection body is preferably arranged coaxially to the axis of rotation and non-movably connected to the rotary bell. The deflection body is moreover rotationally symmetrical and comprises an impact surface, which is opposite the delivery openings, and an outer lateral surface which extends substantially parallel to the discharge surface of the rotary bell.

To construct the deflection body so that it is as light as possible, it is preferably designed as a hollow truncated cone.

An negative pressure is produced in the internal region of the rotary bell during operation so that there is a risk of coating material being sucked from the breakaway edge to the centre of the rotary bell. This in turn influences the geometry of the spray jet. To prevent the coating result being impaired as a result, it is advantageous if continuous air-passage bores, which ensure a pressure-equalisation, are incorporated through the deflection body defining the impact surface.

The deflection body is accommodated in the space delimited by the discharge surface of the rotary bell, which is likewise in the form of a truncated cone. It is advantageous here if the diameter of the deflection body is less than 60% of the breakaway-edge diameter. A deflection-body diameter which is approximately a third of the breakaway-edge diameter is particularly advantageous. The breakaway-edge diameter can be in a range between 20 and 90 mm, with a correspondingly greater discharge surface being available when the breakaway edge is larger. This can generate a thinner coating-medium film, which results in smaller and more uniform droplets.

To save energy, it is expedient to construct the rotating components so that they are as light as possible. The nozzle head can be made from a bell part, which comprises the rotary bell and the delivery region, and from a conical side wall such that a cavity is produced between the bell part and the side wall. The side wall and the bell part can be non-movably connected to one another for example by means of adhesion, welding, screwing, riveting or shrinking.

It is advantageous if a material with a low density is used as the material for the bell part, the side wall and the deflection body, so that the masses to be moved are kept as small as possible. Suitable materials are for example titanium, aluminium or alloys such as Ti-6Al-4V, 6Al-4V or 6Al-25N-4Zr-2Mo, depending on the coating material and friction from particles in the coating material.

Provision can furthermore be made for the discharge surface to have grooves, in particular radial grooves, in an annular region. Provision can be made in particular for the grooves to be arranged in a radially outermost annular region of the discharge surface, which terminates in the breakaway edge. This generates initial points for the formation of droplets.

Alternatively or additionally, an angle between the discharge surface and the axis of rotation can become smaller in the direction of the breakaway edge in an annular region. It is particularly advantageous here if the angle varies continuously in a radially outermost annular region of the discharge surface. As a result of the deflection of the coating material, a droplet which separates from the breakaway edge experiences a lower acceleration in the radial direction, so that the maximum radius of the spray jet can be reduced.

Provision can moreover be made for the angle between the discharge surface and the axis of rotation to vary a plurality of times in the direction of the breakaway edge, with different annular regions of the discharge surface each having different constant angles in a range of 50° to 85°. As a result of steps which are produced in this way, regions with different flow conditions, in which the coating material experiences different acceleration components, can be generated on the discharge surface. A laminar flow of the coating material is desirable for a uniform droplet-size distribution. To ensure this, the transitions between the annular regions should be constructed as continuously as possible with a steadily changing angle.

Provision can furthermore be made for a guide air device to be used to collimate the spray jet. This preferably has a plurality of guide air units which are constructed as nozzle rings. These are arranged coaxially to the axis of rotation on the housing of the rotary atomizer outside the nozzle head and can have nozzle openings of differentsizes. A flow rate of 200 to 300 L $min^{-1}$ has proven expedient here.

To focus the spray jet further, the coating material can be directed onto the object to be coated with the aid of an electrical field. Provision can be made here for the coating material itself to be charged directly to a high voltage of 20 to 50 kV, preferably 30 kV, within the flow path by means of a high-voltage generator and for the object to be coated to be earthed.

Alternatively, the electrostatic charging can take place externally using needle electrodes, which are mounted radially around the bell and are at a negative DC voltage potential. The voltage is in the range between −40 kV and −100 kV. The electrons produced by the needlepoints as the air is ionised can charge the droplets negatively so that these move in the direction of the earthed object to be coated, whereby the coating efficiency can be increased.

A purging-agent spray device can be provided to remove impurities on the rotary atomizer which are produced by coating material which does not arrive on the object to be coated. This can be arranged on the side wall of the bell part and can clean this side wall as required.

With a change of coating material, the entire flow path is purged with solvent to prevent intermixing. To expel residues of the coating material from the supply lines or to clean these latter of solvent, a pig can be used which is movable back and forth and removes the fluid from the interior surface of the line section as it moves through it.

The nozzle head described is part of a paint-spray device for coating objects, which can have many paint sources with up to 50 different paints. The paint-spray device can comprise a plurality of spray booths which are supplied with coating material by associated distribution lines. Each spray booth can contain a plurality of robots or handling means which carry rotary atomizers.

There are furthermore one or more paint-change valves so that there is only ever one paint present between paint changer and atomizer in the line. Metering and storage containers can furthermore be provided between paint changer and atomizer, the precise arrangement of the storage containers and paint changers is not relevant. The object described above is achieved with a rotary atomizer of the type mentioned at the outset in that a nozzle head with some or all of the features mentioned with reference to it above is provided.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention are explained in more detail below with reference to the drawings, which show.

DESCRIPTION OF PREFERRED EXEMPLARY EMBODIMENTS

Figure 1:
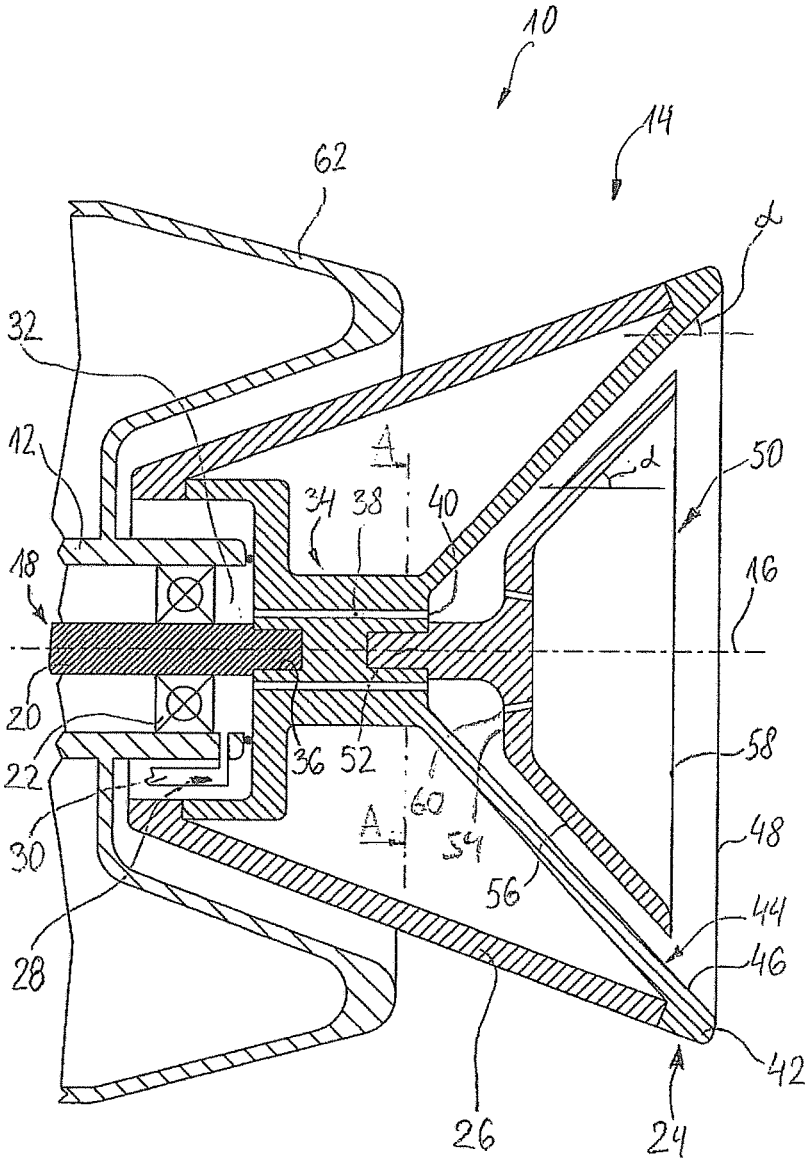
FIG. 1 an axial section of a first exemplary embodiment of a nozzle head with a solid shaft as the drive shaft.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

1. Basic Construction of the Rotary Atomizer

In the figures, 10 denotes a rotary atomizer as a whole, of which merely a head portion with a housing 12 and a nozzle head 14 is shown. The rotary atomizer10 can be used to apply coating material, in particular paint, to an object which is not shown specifically.

The nozzle head 14 comprises a bell part 24, which is rotatable at high speed about an axis of rotation 16 and is coupled to a drive shaft 18 for this purpose.

In the nozzle head 14 shown in FIG. 1, the drive shaft 18 is constructed as a solid shaft. The drive shaft 18 is mounted in the housing 12 by way of sealed radial bearings 22 and can be driven for example by means of an electric motor or pneumatically by means of a compressed-air turbine. During operation, the bell part 24 rotates about its axis of rotation 16 at speeds of 10,000 to 100,000 rpm.

The bell part 24 comprises a rotary bell 42 and a side wall 26, which adjoins the rotary bell 42 radially on the outside, which rotary bell and side wall are non-movably connected to one another and together surround a cavity. This design of the bell part 24 enables its inertia to be kept low so that it is possible to save on drive energy.

Coating material to be applied is supplied from the side of the drive shaft 18 to the nozzle head 14 by way of a flow path 28. To this end, in FIG. 1, a line 30 which is eccentric to the axis of rotation 16 supplies the coating material to a coaxial channel 32 which is annular in the present exemplary embodiment and is delimited in the radial direction by the solid shaft 20 on the inside and by the housing 12 on the outside. In the axial direction, the channel 32 is delimited on the one side by the radial bearing 22 and, on the opposite side, leads into a cylindrical delivery region 34 of the bell part 24, which is arranged coaxially to the axis of rotation 16. In this arrangement, a free end of the drive shaft 18 is non-movably connected by way of a hub 36 to the delivery region 34 of the bell part 24, for example by means of an adhesive connection or a press fit. The rotational movement of the drive shaft 18 is thereby transmitted to the bell part 24.

Figure 2:
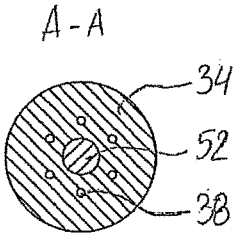
FIG. 2 a radial section of a delivery region of the nozzle head according to FIG. 1, in which sub-paths of the flow path extend.

In the delivery region 34, the flow path 28 divides into a plurality of sub-paths 38 which, in the exemplary embodiments, are designed as through-bores which extend parallel to the axis of rotation 16. In the exemplary embodiment shown in FIG. 1, six sub-paths 38 lead into delivery openings 40 which are arranged coaxially on a circle around the axis of rotation 16. The arrangement of the sub-paths 38 is shown in the radial section A-A in FIG. 2.

The rotary bell 42 is frustoconical and adjoins the delivery region 34, likewise being arranged coaxially to the axis of rotation 16. The rotary bell 42 can also have geometries which deviate from this, such as are known per se in rotary bells from the prior art. The rotary bell 42 has a frustoconical inner lateral surface 44, which serves as a discharge surface 46. At the outer edge which is remote from the drive shaft 18, the discharge surface 46 terminates in a circumferential breakaway edge 48. The discharge surface 46 forms an angle $\alpha$ with the axis of rotation 16. This is approximately 45°; angles in a range of 40° to 85° are particularly possible. A rotary-bell diameter in a range of 20 mm to 90 mm has proven favourable, with the coating material generally flowing as a thinner film in the case of larger rotary-bell diameters, resulting in the formation of smaller droplets at the breakaway edge.

The inner lateral surface 44 of the rotary bell 42 surrounds a frustoconical volume in which a deflection body 50 is arranged. This is received coaxially to the axis of rotation 16 of the nozzle head 14 in an end of the delivery region 34 which is remote from the drive shaft 18. In the present exemplary embodiment, a connecting piece 52 of the deflection body 50 is non-movably connected here to the delivery region 34 of the bell part 24; this can be effected for example by means of an adhesive connection or a press fit. The deflection body 50 therefore follows the rotational movement of the bell part 24.

The outer lateral surface of the connecting piece 52 of the deflection body 50 leads into an annular impact surface 54, which in turn merges into a frustoconical outer lateral surface 56 which terminates in a circumferential terminating edge 58. In the present exemplary embodiment, the impact surface 54 extends substantially in a plane'perpendicular to the axis of rotation 16.

Coating material, which exits from the delivery openings 40, strikes the impact surface 54 arranged opposite. Owing to the rotation of the rotary bell 24 and the deflection body 50, this coating material flows radially outwards on the impact surface 54 as a film and to the inner discharge surface 46 of the rotary bell 42. The coating material flows further on this to the breakaway edge 48, where the film separates from the rotary bell 42 in the form of jets or lamellae from which droplets are then produced. As mentioned at the outset, it is desirable to generate small droplets.

Depending on the speed of the rotary bell, the mean size of the droplets which are spun off from the rotary bell 42 varies in a rotary atomizer. The slower the speed of the rotary bell 42, the larger the generated droplets. However, it is at the same time desirable to rotate the rotary bell 42 at low speeds to save energy.

The division of the flow path 28 into sub-paths 38 in the delivery region 34 counteracts the undesired effect of larger droplets being spun off from the rotary bell 42 at slower speeds. As a result of their eccentricity, the sub-paths 38 act as radially arranged carriers and can transmit additional rotational energy to the coating material. Consequently, all of the coating medium exits the delivery openings 40 at a higher absolute speed than if it were only supplied centrally. A coating material which is accelerated in this way therefore strikes the impact surface 54, and then the discharge surface 46, with a greater kinetic energy to then flow in a thinner film to the breakaway edge 48, resulting in the formation of smaller more uniform droplets.

In the present exemplary embodiments, the impact surface 54 is constructed to be substantially perpendicular to the axis of rotation 16. An inclined impact surface 54 is likewise conceivable.

As mentioned above, the impact surface 54 merges into the frustoconical outer lateral surface 56. This forms an angle $\alpha$ with the axis of rotation 16, which is the same size as the angle formed by the discharge surface 46 of the rotary bell 42 and the axis of rotation 16. The outer lateral surface 56 and the discharge surface 46 therefore extend parallel to one another. If coating material also flows along the outer lateral surface 56 of the deflection body 52 at slower speeds, it is delivered at the latest at the terminating edge 58 thereof and strikes the discharge surface 46 of the rotary bell 42. A diameter of the terminating edge 58 which is less than 60% of the diameter of the rotary bell has proven favourable.

The deflection body 50 is constructed as a hollow truncated cone to reduce the inertia of the nozzle head 14 as a whole. To reduce the suction effect of the cavity formed in this way, air-passage bores 60 are arranged in the impact surface 54. These ensure a pressure equalisation and therefore improve the distribution of the coating material which has been spun off from the breakaway edge 48. In FIG. 1, two such air-passage bores 60 are shown, with these being designed in such a way that the unimpeded passage of coating material can be prevented. To this end, these have only a small diameter and moreover have an inclination which is opposed to the inclination of the outer lateral surface 56.

A further option for influencing the geometry of the spray jet generated by the nozzle head 14 is through the use of a guide-air unit, which is not shown specifically. For example, an annular nozzle can be arranged on a housing collar 62, which partly covers the nozzle head 14. This annular nozzle directs guide air onto the generated spray jet to delimit it in the radial direction. Further design options for the guide-air unit are revealed in DE 10 2012 010 610 A1.

To remove residues of coating material on the side wall of the nozzle head 14, a purging-agent spray device (not shown specifically) can be provided. This can be arranged on the side wall of the bell part and can clean this latter with solvent as to required.

When changing the coating material, the flow path 28 is fully purged with solvent to prevent intermixing of different materials. To this end, a pig (not shown specifically) which is movable back and forth can be provided in the supply lines leading to the nozzle head 14, which pig removes coating-material residues from the walls of the supply lines from the inside.

2. Further Exemplary Embodiments of the Nozzle Head

Figure 3:
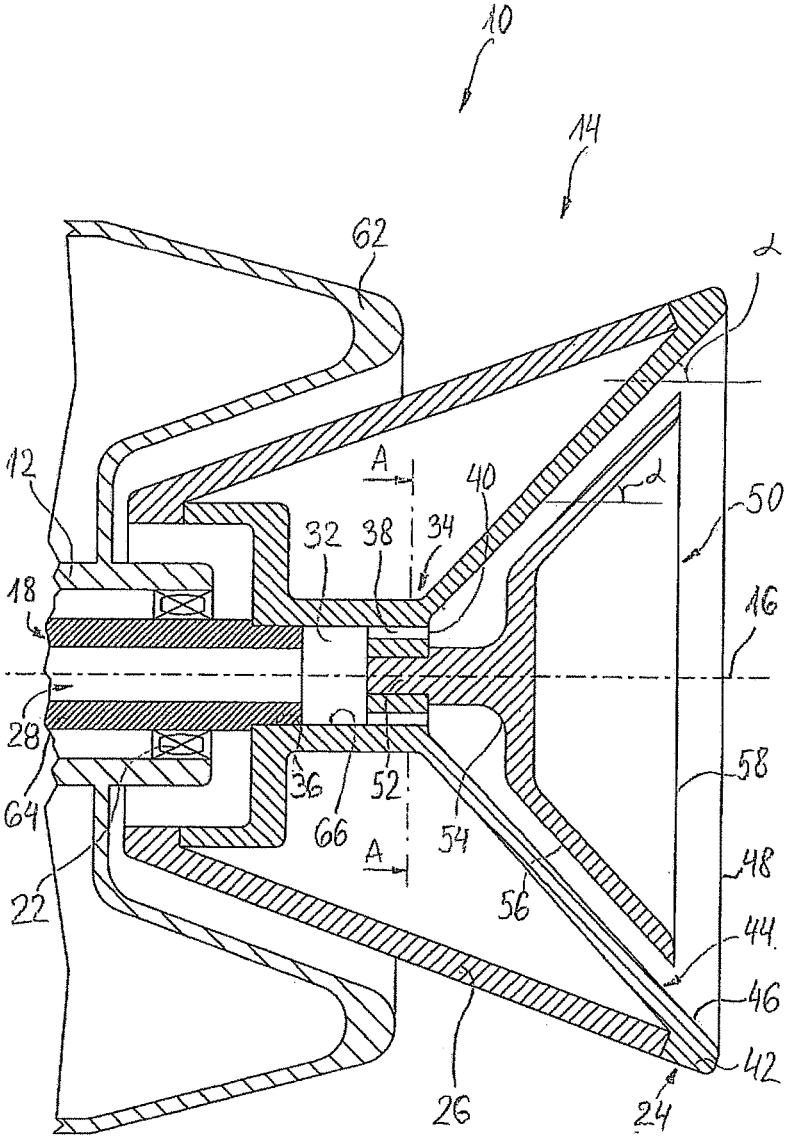
FIG. 3 an axial section of a second exemplary embodiment of a nozzle head with a hollow shaft as the drive shaft.

FIG. 3 shows a further exemplary embodiment of the nozzle head 14, in which the drive shaft 18 is constructed as a hollow shaft 64. The coating material is supplied to the delivery region 34 of the bell part 24 through the hollow shaft 64 by way of the coaxial channel 32. The coaxial channel 32 in the present exemplary embodiment is constructed as a central bore 66 in the bell part 24 and is located between the hub 36, which receives the hollow shaft 64, and the delivery region 34 in which the sub-paths 38 extend.

Figure 4:
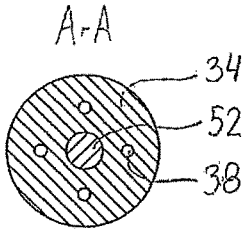
FIG. 4 a radial section of the delivery region of the nozzle head according to FIG. 3, in which sub-paths of the flow path extend.

The central bore 66 has the same diameter as the outer circle which is formed by the radially outermost points of the eccentrically arranged sub-paths 38. This makes it easier for the coating material to flow out of the coaxial channel 32 into the sub-paths 38. In this exemplary embodiment, four sub-paths 38 lead into the delivery openings 40, which are arranged on a circle around the axis of rotation 16. The arrangement of the sub-paths 38 is shown in the radial section A-A in FIG. 4.

In the present exemplary embodiment, the deflection body 50 and the delivery region 34 can be connected to one another, again for example by means of an adhesive connection or a press fit or alternatively by means of a screw connection, which is not shown specifically. To this end, the end portion of the connecting piece 52 can project into the central bore 66 and have a thread which can connect the deflection body 50 and the delivery region 34 non-movably to one another in conjunction with a threaded nut.

Figure 5:
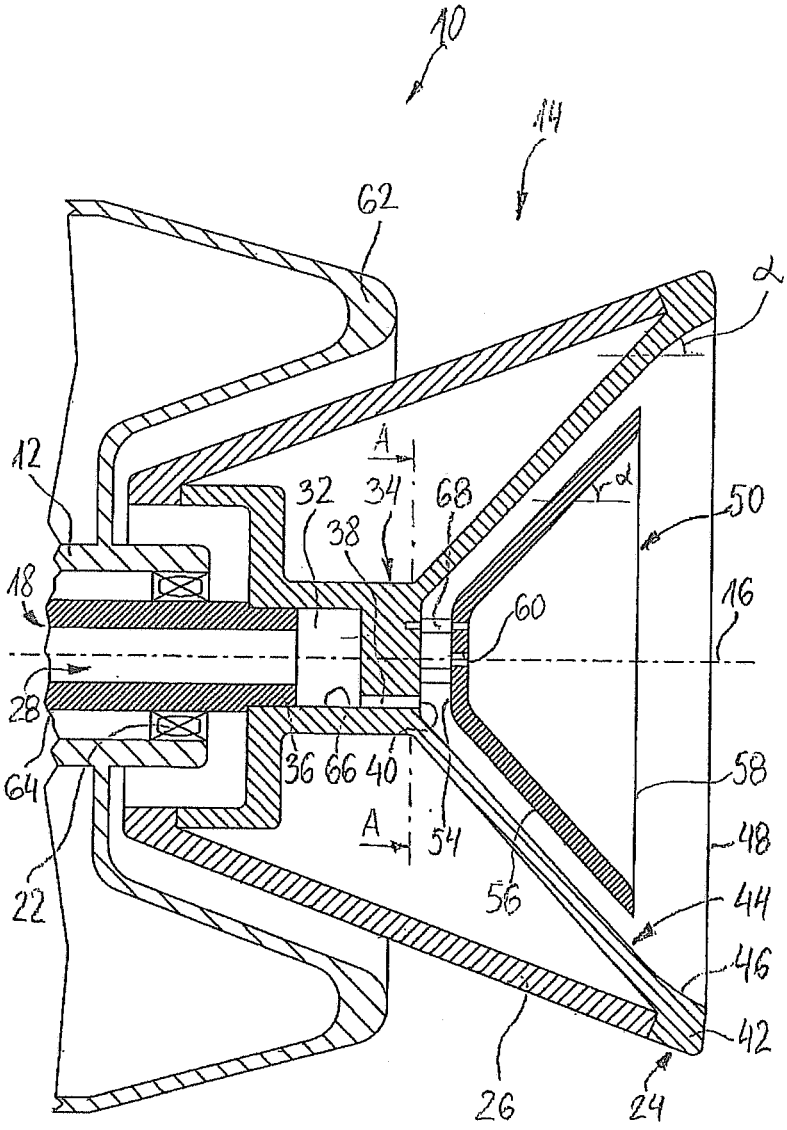
FIG. 5 an axial section of a third exemplary embodiment of a nozzle head with a hollow shaft as the drive shaft.
Figure 6:
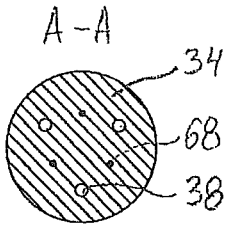
FIG. 6 a radial section of the delivery region of the nozzle head according to FIG. 5.

FIG. 5 shows a third exemplary embodiment which is based on the exemplary embodiment of FIG. 3. In contrast to this, the deflection body 50 here does not have a connecting piece, but is non-movably fastened to the delivery region 34, coaxially to the axis of rotation 16, by way of pins 68. As the radial section A-A in FIG. 6 shows, three pins 68 are arranged on a circle around the axis of rotation 16. In this exemplary embodiment, three sub-paths 38 lead into the three delivery openings 40, which are likewise arranged on a circle around the axis of rotation 16. A through bore which is arranged centrally in the impact surface 54 serves as an air-passage bore 60, as shown in FIG. 5.

To influence the geometry of the spray get generated by the nozzle head 14, in the present exemplary embodiment the angle $\alpha$ between the axis of rotation 16 and the discharge surface 46 varies. In particular, the angle α becomes smaller in the direction of the breakaway edge 48. As a result of the coating material film being deflected, its velocity component in the axial direction is increased at the expense of the velocity component in the radial direction. The coating material therefore experiences a reduced acceleration in the radial direction, which means that the maximum radius of the spray jet can be reduced.

Figure 7:
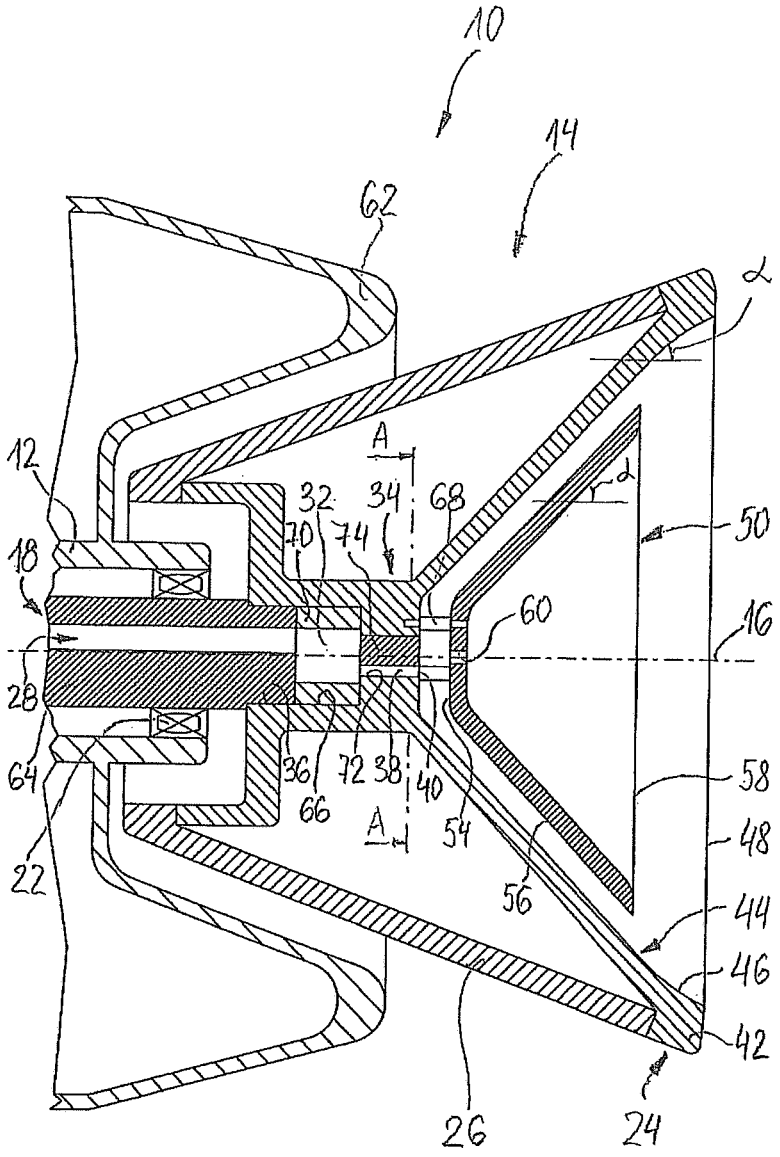
FIG. 7 an axial section of a fourth exemplary embodiment of a nozzle head, in which an insert part is arranged in a central bore of the delivery region.

A further exemplary embodiment is shown in FIG. 7, In this, the drive shaft 18 is likewise constructed as a hollow shaft 64 although the axial bore, which forms part of the flow path 28, is eccentric to the axis of rotation 16. The coating material coming from the hollow shaft 64 arrives at the delivery region 34 by way of the coaxial channel 32. In this exemplary embodiment, the coaxial channel 32 likewise extends in a central bore 66 in the bell part 24, with a bush 70 inserted in the central bore 66 forming the wall of the coaxial channel 32. The diameter of the coaxial channel 32 is therefore matched to the diameter at which the eccentric axial bore in the hollow shaft has its radially outermost point, which contributes to reducing dead space in the flow path 28.

Figure 8:
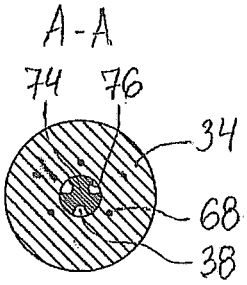
FIG. 8 a radial section of the delivery region of the nozzle head according to FIG. 7.

The coating material arrives in the sub-paths 38 of the delivery region 34 from the coaxial channel 32. In this exemplary embodiment, the sub-paths 38 are formed in that an insert part 74 is inserted in a central delivery bore 72 passing through the delivery region 34. The insert part 74 has a cylindrical basic shape and has three axial grooves 76 on its circumferential surface, which form the sub-paths 38 for the coating material together with the wall of the central delivery bore 72. The arrangement of the sub-paths 38 is shown in the radial section A-A in FIG. 8. The three sub-paths 38 lead into three delivery openings 40.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A nozzle head for a rotary atomizer for applying a coating material to an object comprising:

a) a rotary bell which is rotatable about an axis of rotation and has a breakaway edge and a discharge surface to which a coating material can be supplied in such a way that the coating material is spun off from the breakaway edge of the rotary bell, and b) a flow path via which the coating material can be supplied to the discharge surface, wherein c) the flow path comprises a coaxial central channel and a delivery region, the coaxial central channel being located upstream from the delivery region, and the delivery region is divided into sub-paths, each sub-path having a delivery opening which is arranged eccentrically to the axis of rotation of the rotary bell, wherein the coating material flows first through the coaxial central channel and then through each sub-path and the delivery opening of each sub-path before arriving at the discharge surface.

2. The nozzle head according to claim 1, wherein the delivery openings are arranged rotatably about the axis of rotation of the rotary bell.

3. The nozzle head according to claim 1, wherein the delivery region has at least two delivery openings, which are arranged on a circle which is coaxial to the axis of rotation.

4. The nozzle head according to claim 3, wherein the delivery region is constructed in an extension of the central channel in which an insert part is inserted in such a way that the flow path is divided.

5. The nozzle head according to claim 3, wherein at least the coaxial central channel is received in a drive shaft to which the rotary bell is coupled.

6. The nozzle head according claim 1, wherein the coating material delivered by the delivery openings arrives at the discharge surface in that it can be guided onto a deflection body.

7. The nozzle head according claim 1, wherein the discharge surface has grooves in an annular region.

8. The nozzle head according claim 1, wherein an angle between the discharge surface and the axis of rotation becomes smaller in the direction of the breakaway edge in an annular region.

9. A rotary atomizer for applying a coating material to an object with a nozzle head, wherein a nozzle head according to claim 1 is provided.

10. The nozzle head according to claim 7, wherein the discharge surface grooves are radial grooves.

11. The nozzle head according to claim 1, wherein each sub-path has a smaller cross-section than a cross-section of the flow path.

12. The nozzle head according to claim 11, wherein a total cross-section of all of the sub-paths is smaller than the cross-section of the flow path.

13. The nozzle head according to claim 1, wherein the sub-paths are all arranged parallel to the axis of rotation.

14. The nozzle head according to claim 6, wherein the deflection body is non-movably connected to the delivery region by a plurality of pins, the plurality of pins being set on a circumference of a circle.

15. The nozzle head according to claim 14, wherein the deflection body comprises an impact surface and an air-passage bore, the air-passage bore being centrally located on the impact surface.

* * * * *